United States Patent [19]

O'Neill

[11] 4,371,097

[45] Feb. 1, 1983

[54] LIQUID DISPENSING PUMP

[75] Inventor: Richard K. O'Neill, Hacienda Heights, Calif.

[73] Assignee: Diamond International Corporation, New York, N.Y.

[21] Appl. No.: 147,094

[22] Filed: May 7, 1980

[51] Int. Cl.[3] ..... B05B 11/00

[52] U.S. Cl. ..... 222/321; 222/380; 222/383

[58] Field of Search ..... 222/321, 380, 381, 383; 239/333, 329, 331

[56] References Cited

U.S. PATENT DOCUMENTS

| | | | |
|---|---|---|---|
| 2,362,080 | 11/1944 | Martin | 222/321 |
| 3,239,151 | 3/1966 | Boris | 239/333 |
| 3,282,472 | 11/1966 | Roder | 222/321 |
| 3,378,205 | 4/1968 | Barker | 222/402.12 X |
| 3,908,870 | 9/1975 | Nozawa et al. | 222/321 |
| 3,934,763 | 1/1976 | Steiman | 222/321 |
| 4,025,046 | 5/1977 | Boris | 222/321 X |
| 4,061,247 | 12/1977 | Meshberg | 222/321 X |
| 4,117,957 | 10/1978 | Duffey | 222/321 |
| 4,215,804 | 8/1980 | Giuffredi | 222/321 |

*Primary Examiner*—Joseph J. Rolla
*Assistant Examiner*—Frederick R. Handren
*Attorney, Agent, or Firm*—Watson, Cole, Grindle & Watson

[57] ABSTRACT

A liquid dispensing pump includes a one-piece piston capable of not only effecting a pumping operation but also an outlet valve opening and closing function upon limited relative axial movement. In one embodiment, the piston reciprocates and forms a valve seat for a container vent opening extending through a closure cap provided on the pump body, and in another embodiment, the pump cylinder reciprocates and forms a valve seat for opening and closing the container vent opening. The pump chamber defined by the cylinder has a valved inlet which may be formed by a sleeve depending from the piston and an upstanding conduit in the cylinder or may be formed by a ball check valve in the cylinder.

10 Claims, 6 Drawing Figures

LIQUID DISPENSING PUMP

BACKGROUND OF THE INVENTION

This invention relates generally to a portable pump for dispensing liquid, and more particularly to such a pump having a one-piece piston member adapted for carrying out various valving functions thereby reducing the number of parts and rendering the pump easy and efficient to operate.

Prior dispensing pumps of the class herein described generally include a pump plunger in the form of a stem projecting into a valve element which is arranged for reciprocation in a pump chamber and which is provided with an outlet valve seat facing the chamber. The stem is arranged for axial shifting movement relative to the valve element, and has some type of valve member at a terminal end thereof which shifts away from the outlet valve seat upon an initial depression of the stem to thereby open the outlet to permit liquid to be dispensed through an outlet passage extending through the stem upon a further depression of the stem effecting the piston downstroke movement. Pump constructions of this type, however, typically require multiple parts which are specifically configured for carrying out the dispensing operation including inlet opening and closing, outlet opening and closing and container vent opening and closing functions. Moreover, critical dimensions and tolerances are oftentimes required thereby adding to the cost of construction and operation.

SUMMARY OF THE INVENTION

It is therefore an object of this invention to provide a liquid dispensing pump of a basically simple construction with few parts yet which is reliable, economical to manufacture and easy to operate.

The pump according to one embodiment of the invention, includes a pump cylinder forming a pump chamber having a valve-controlled inlet, a reciprocable piston having an annular piston skirt at one end in sliding engagement with the wall of the pump chamber, and a discharge head for effecting downstroke movement of the piston. The head has a discharge orifice and a discharge passage extends through the piston and the head to provide communication between the pump chamber and the orifice. The head and piston are interengaged for relative axial movement so as to open and close an outlet in the discharge passage which is valve-controlled by a valve member at an opposite end of the piston. The pump cylinder has a container vent opening which is valve-controlled by an outwardly flared portion of the piston skirt bearing against an encircling portion of the pump body. Thus, a single-piece piston member functions to effect an opening of the outlet upon initial depression of the discharge head and to force liquid from the pump chamber out through the discharge passage upon continued depression of the discharge head causing piston downstroke. And, at the commencement of the piston downstroke movement, the container vent is opened by the piston. Moreover, the piston member may be conveniently provided with an inlet valve operating means in the form of a depending sleeve engageable in an inlet closing position with a conduit extending into the pump chamber. Otherwise, the valve-controlled inlet may be in the form of a ball check valve.

In accordance with another embodiment, the dispenser is of the trigger operated variety and the pump cylinder reciprocates relative to the piston. A pump body containing the cylinder and piston has a portion terminating in a discharge orifice, a discharge passage extending through the piston and such portion provides communication between the pump chamber and such orifice. The pump body engages the piston for limited relative axial movement of the piston between discharge closing and opening positions. A trigger fulcrumed on the body has a cam portion engaging the cylinder for movement of the piston into such discharge opening position and for movement of the cylinder upon operation of the trigger between compression and suction strokes relative to the piston.

Other objects, advantages and novel features of the invention will become more apparent from the following detailed description of the invention when taken in conjunction with the accompanying drawings.

DETAILED DESCRIPTION OF THE INVENTION

Figure 1:
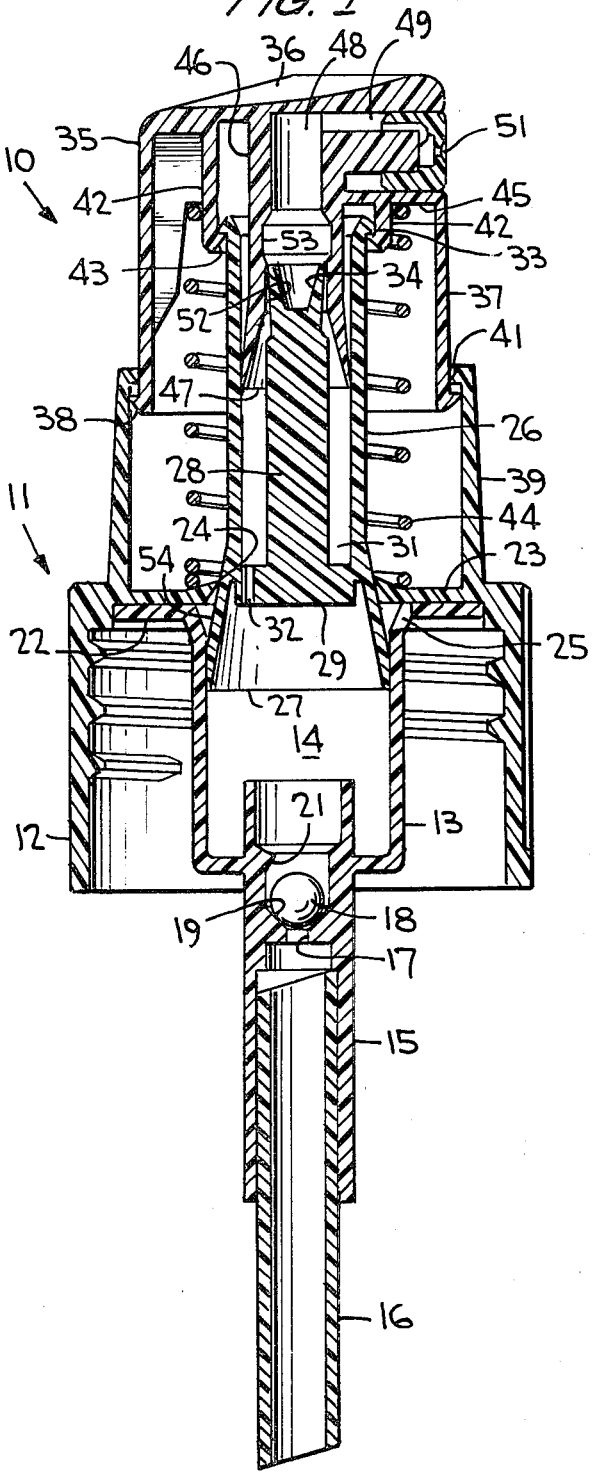
FIG. 1 is a vertical sectional view of one embodiment of the liquid dispensing pump according to the invention.
Figure 2:
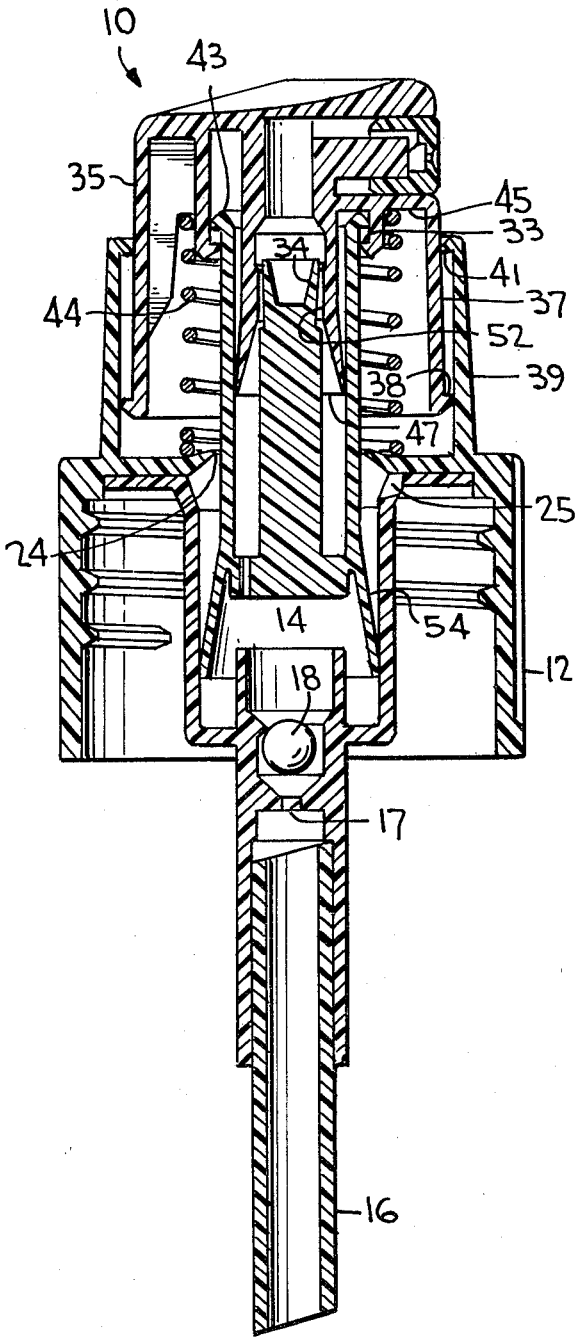
FIG. 2 is a view similar to FIG. 1 except that the discharge head and piston are shown at the beginning of the piston upstroke with the ball valve unseated.

Turning now to the drawings wherein like reference characters refer to like and corresponding parts through the several views, one embodiment of a dispensing pump according to the invention is generally designated 10 in FIGS. 1 and 2 and includes a pump body 11 having an internally threaded cap 12 for affixing the pump to a liquid container (not shown). The cap surrounds a pump cylinder 13 defining a pump chamber 14. An inlet conduit 15 depends from the pump cylinder and a dip tube 16 is force fitted within the inlet conduit and extends below the level of liquid within the container as in any conventional manner. The inlet conduit has an inlet opening 17 which is valve-controlled by means of a conventional ball check valve 18 seated on a valve seat 19, and limited, when unseated, by a stop 21. The pump cylinder has a transversely extending annular flange 22 underlying a transverse wall 23 of the cap, wall 22 being affixed in any normal manner to the pump body. Wall 23 has a central opening 24 forming a tapered wall which defines a valve seat for a valve-controlled container vent opening 25 located in the wall of the pump cylinder.

A one-piece piston member 26 has an annular and outwardly flared piston skirt 27 at its lower end adapted for sliding engagement with the wall of the pump chamber during piston reciprocation. The piston is essentially a hollow tube extending outwardly of opening 24 and having a coaxial post 28 mounted therein by a transverse disc 29. The post is spaced from the inner wall of the piston so as to define an annular space 31 which opens into the pump chamber via a hole or holes 32 located in disc 29.

The piston has at its upper end an outwardly extending annular stop shoulder 33, and post 28 has at its upper end a valve member in the form of an annular and resilient valve skirt 34 which is shown in FIG. 1 as slightly compressed radially inwardly in its seated position.

Dispensing pump 10 further includes a discharge head 35 having an upper wall containing a conventional finger piece 36 for the convenient reception of the operator's finger during pump operation. An outer annular wall or skirt 37 depends from the upper wall and has an outwardly extending annular stop shoulder 38 thereon. An upstanding annular wall 39 on pump body 11 has an inwardly extending annular stop shoulder 41 for engagement with shoulder 38 in the fully raised position of the discharge head shown in FIG. 1.

The discharge head also has a depending inner annular wall or skirt 42 with an inwardly extending annular stop shoulder 43 at the terminal end thereof. This stop shoulder interengages with stop shoulder 33 of the piston when the discharge head and piston are urged into their fully raised position of FIG. 1 by a return spring 44 which bears at its lower end against wall 23 of the pump body and at its upper end against an abutment wall 45 located within the discharge head. A hollow discharge conduit 46 depends from the upper wall of the discharge head and terminates in a resilient skirt 47 which frictionally engages the inner wall of the piston member. Conduit 46 has a central opening 48 communicating via an annular space 49 with a discharge orifice 51 of typical construction designed to effect a spray of the liquid to be dispensed. Space 49, opening 48, space 31 and hole 32 define a discharge passage providing communication between pump chamber 14 and the discharge orifice during the pumping operation. This discharge passage is closed in the fully raised position of the discharge head, as shown in FIG. 1, by an outlet valve formed by valve skirt 34 seated against wall 52 of opening 48. A portion 53 of this wall has an enlarged diameter formed adjacent the upper end of skirt 34 in the fully raised FIG. 1 position. And, in this position, the upper end of the piston is spaced a slight distance away from abutment wall 45 to permit a limited axial movement of the discharge head relative to the piston between the position shown in FIG. 1 and that shown in FIG. 2.

An outer wall 54 of piston skirt 27 flares outwardly in a direction toward the lower end of the piston and functions as a valve member for closing container vent 25 as wall 54 is seated against the edge of central opening 24 while in the fully raised position of the piston shown in FIG. 1.

It can be therefore seen that the piston member of the aforedescribed pump functions not only as a pump piston, but also as a valve member for opening and closing the container vent and as a valve member for opening and closing the outlet. Thus, after the pump chamber is suitably primed with liquid to be dispensed, the discharge head is depressed from its FIG. 1 toward its FIG. 2 position. Initially, the discharge head moves, when depressed by the operator, a limited distance defined between abutment wall 45 and the upper end of the piston. The discharge passage is thus opened as enlarged portion 53 is shifted into juxtaposition with valve skirt 34 thereby permitting uninterrupted passage of liquid between skirt 34 and wall 52. When wall 45 abuts against the upper edge of the piston, continued downward movement of the discharge head moves the piston downwardly toward its FIG. 2 position whereupon the liquid in the pump chamber is compressed and dispensed through the open discharge passage and out through the discharge orifice. Any escapement of liquid between conduit 46 and the inner wall of the piston is prevented during the discharge operation as the liquid under pressure forces the flared skirt radially outwardly into tight sealing engagement with the inner wall of the piston. And, at the commencement of the piston downstroke movement, outer wall 54 of the piston skirt moves away from the edge of central opening 24 thereby leaving a gap through which atmospheric air is admitted via container vent 25 into the container interior to replace the liquid product which is withdrawn from the container during the pumping operation. Atmospheric air is admitted from outside the pump between walls 37 and 39 since their shoulders 38 and 41 do not sealingly engage the walls along which they slide. These walls 37 and 39 function as a guide during reciprocation of the discharge head, and allow the discharge head to reciprocate without tilting and without interference. The piston and discharge head are returned to their FIG. 1 position by return spring 44 upon release of the finger pressure on the head. FIG. 2 illustrates the commencement of this return stroke during which the pump chamber is replenished with liquid from the container through inlet 17 as the negative pressure created upon an expanding pump chamber effects a lifting of ball valve 18 off its seat.

Figure 3:
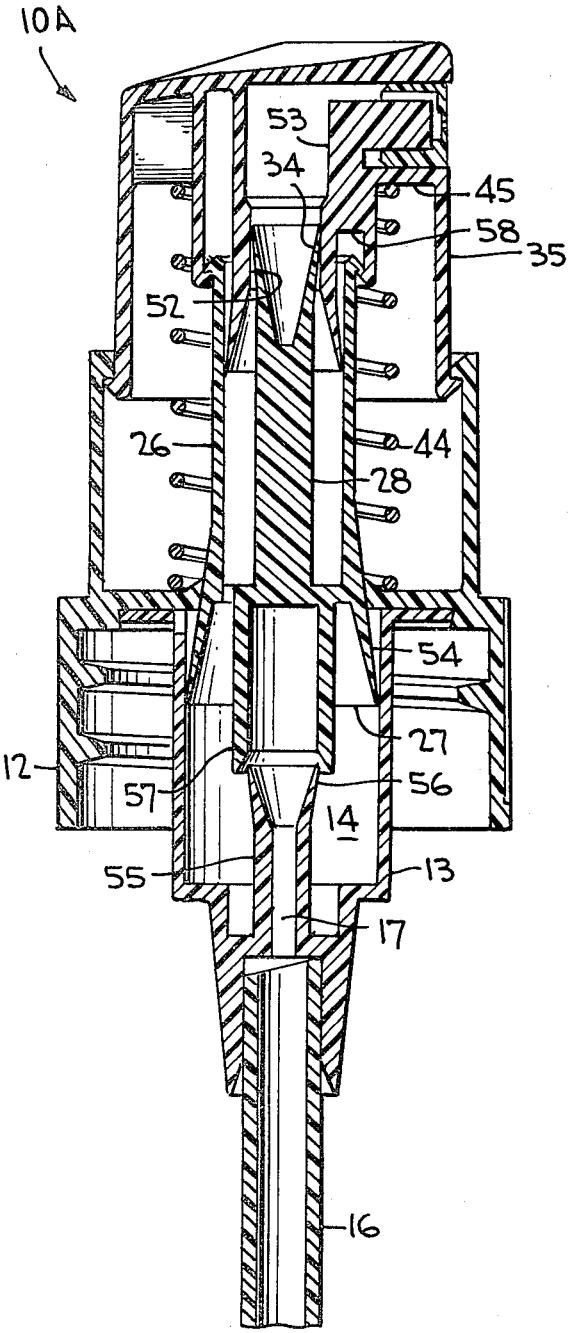
FIG. 3 is a vertical sectional view of a dispensing pump according to another embodiment of the invention.
Figure 4:
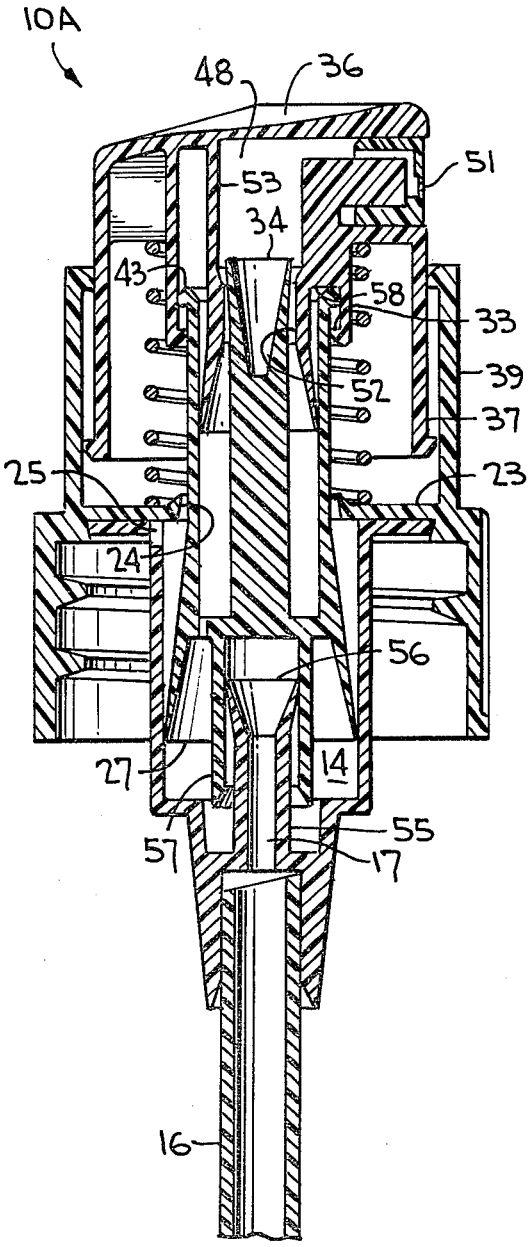
FIG. 4 is a view similar to FIG. 3, but showing the discharge head and piston depressed during a pumping operation.

Liquid dispensing pump 10A shown in FIGS. 3 and 4 is essentially the same as pump 10 of FIGS. 1 and 2 so that like reference numerals are used to identify the same parts. The only difference lies in the type of valve-controlled inlet provided for pump 10A. Inlet 17 extends through a short upstanding conduit 55 having an outwardly flaring lip 56 at its upper end. A sleeve 57 depends from the bottom of the piston in alignment with conduit 55 and is spaced from the upper end thereof in the fully raised position of the piston shown in FIG. 3. The single-piece piston member thus has an additional feature, as compared to that of FIG. 1, of effecting a closing and opening of the inlet during piston reciprocation. Thus, when the discharge head is depressed to its FIG. 4 position during the pumping operation, the head initially moved downward relative to the piston as limited by the distance between the upper end of the piston wall and an abutment wall 58 provided on the head. Enlarged portion 53 of opening 48, as in the FIG. 1 embodiment, is thus shifted into juxtaposition with valve skirt 34 to effect an opening of the discharge passage. Continued downward movement of the discharge head effects a downstroke movement of the piston which compresses the liquid in the pump chamber and forces the liquid under pressure through the discharge passage outwardly via discharge orifice 51. At the commencement of the piston downstroke, outer wall 54 of the piston skirt moves away from the edge of central opening 24 thereby forming a gap through which air is admitted via container vent 25 into the container interior to replace the discharged liquid. During the piston downstroke, the inlet is closed as sleeve 57 telescopes over conduit 55 and its lip 56 which frictionally slides along inner wall of sleeve 57, as shown in FIG. 4. Upon the release of finger pressure, the piston and discharge head are returned to their FIG. 3 position under the action of return spring 44 thereby expanding the volume of the pump chamber and creating a negative pressure which draws liquid through the inlet and into the pump chamber when sleeve 57 moves away from the end of lip 56 toward its fully raised position of FIG. 3.

Figure 5:
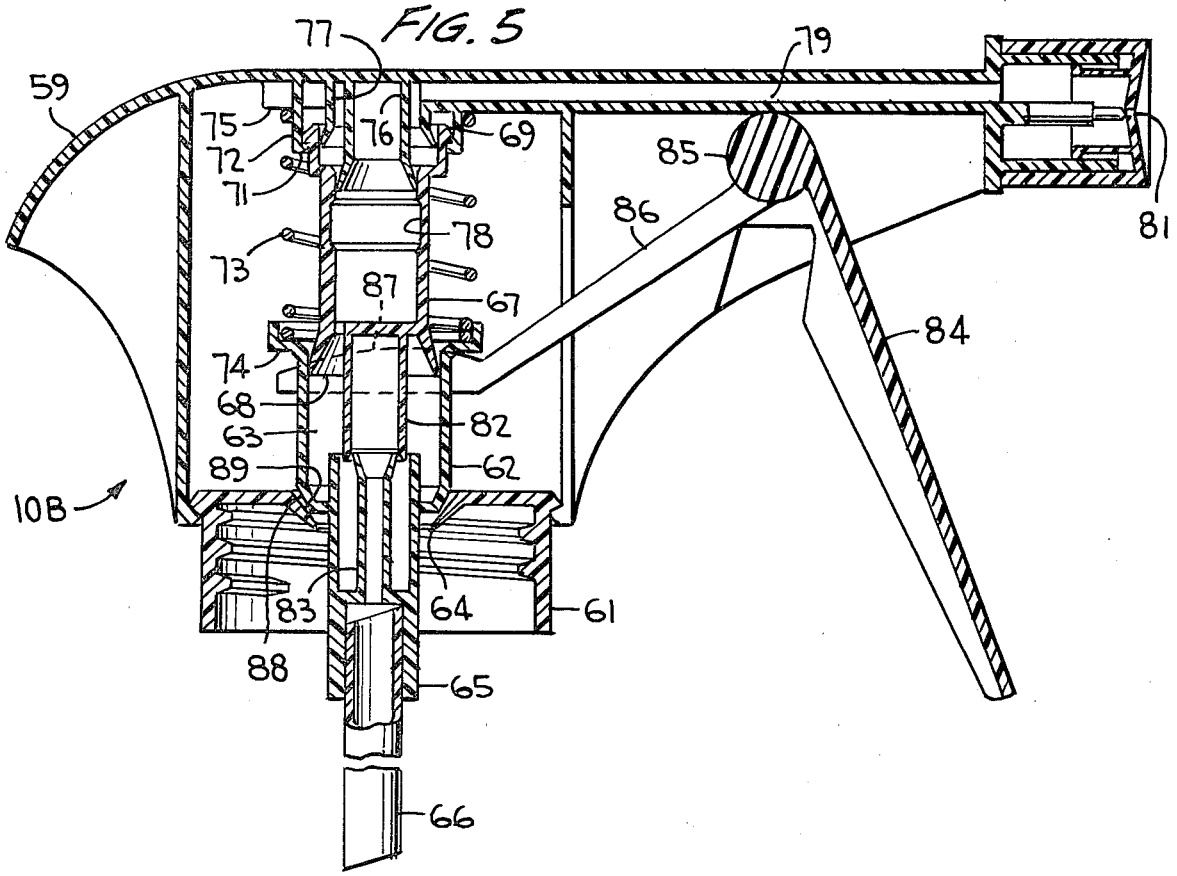
FIG. 5 is a vertical sectional view of a trigger operated dispensing pump according to another embodiment of the invention.
Figure 6:
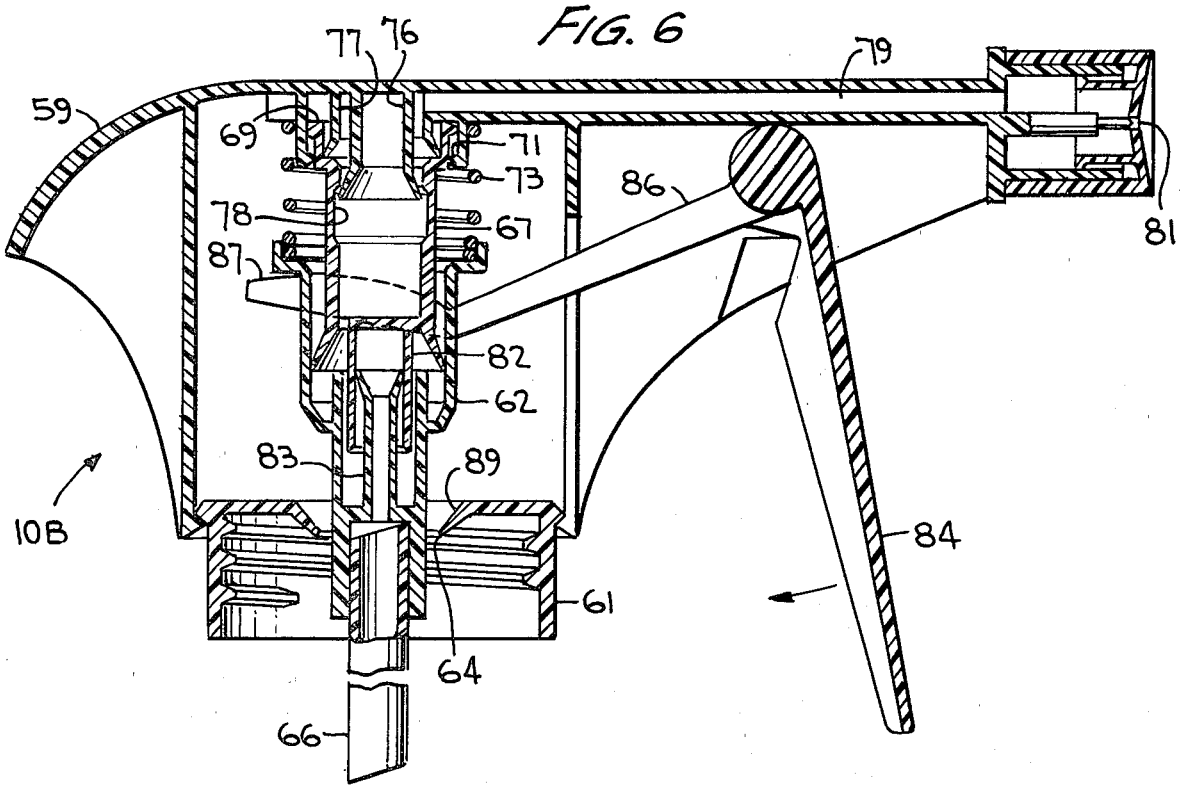
FIG. 6 is a view similar to FIG. 5 with the pump cylinder shown elevated by operation of the trigger in a pump dispensing position.

A further embodiment according to the invention is shown in FIGS. 5 and 6 as a trigger operated dispensing pump generally designated 10B. This pump includes a pump body 59 having a closure cap 61 thereon which is internally threaded to facilitate securement of the pump body to a liquid container (not shown). A pump cylinder 62 within the pump body defines a pump chamber 63 coaxial with a central opening 64 provided in the upper wall of the closure cap. A tubular projection 65 extends downwardly from cylinder 62 and has a dip tube 66 affixed thereto.

A one-piece piston member 67 extends outwardly of the pump cylinder and has an outwardly flared skirt 68 at its lower end in engagement with the wall of the pump chamber. Similarly as in the aforedescribed embodiments, the upper end of the piston has an outwardly extending annular stop shoulder 69 in engagement with an inwardly extending annular stop shoulder 71 provided at the terminal end of a skirt 72 depending from the upper end of the pump body. Shoulders 69 and 71 are maintained interengaged as in FIG. 5 under the action of a return spring 73 which bears at its lower end against a shelf 74 provided on the pump cylinder and at its upper end against an abutment wall 75 provided within the pump body. This wall is spaced from the upper end of the piston to permit limited axial movement of the piston relative to the pump body at the initiation of trigger movement to be more fully described hereinafter. Concentric skirts 76 and 77 have outwardly flared lower ends in engagement with the inner wall of the piston member, and are radially spaced apart to define a passage therebetween. A portion 78 of this inner wall has an enlarged diameter located adjacent the lower end of skirt 76 in the inoperative pump position of FIG. 5.

A discharge passage 79 is formed in the pump body, the passage extending from the space between skirts 76 and 77 to a discharge orifice 81.

The pump chamber has a valve controlled inlet formed by a sleeve 82 depending from the piston and an upstanding conduit 83 located within tube 65 and communicating with the interior of the container via the dip tube. In the inoperative position of FIG. 5, sleeve 82 and conduit 83 are out of engagement in an open position of the inlet valve.

An actuating lever or trigger 84 is provided for manual operation and is pivoted or fulcrumed on the pump body by means of a trunion 85 or the like. The trigger includes a bifurcated arm 86 having at the terminal end thereof a cam surface 87. This cam surface engages the undersurface of flange 74 of the pump cylinder. And, the lower end of the cylinder is formed as a valve seat 88 which in the FIG. 5 position, bears against wall 89 surrounding central opening 64 located in the closure cap.

Therefore, assuming the pump chamber to be primed with liquid to be dispensed, movement of the trigger in the direction of the arrow of FIG. 6 raises the pump cylinder against the action of return spring 73 and, because of the sealing engagement between the piston skirt and the pump chamber wall, initially shifts the position upwardly a limited extent relative to the pump body. Enlarged portion 78 is consequently shifted relative to the lower end of skirt 76 to thereby form a gap as shown in FIG. 6 through which liquid is dispensed from the pump chamber into the discharge passage and out through the discharge orifice. A discharge outlet is therefore valve controlled during the limited shifting movement of the piston between its outlet valve closing position of FIG. 5 and its outlet valve opening position of FIG. 6. A continued pull on the trigger moves the pump cylinder to its raised position of FIG. 6 and causes the liquid within the pump chamber to be compressed and forced out through the discharge via the opened outlet. Relative movement between the piston and cylinder causes sleeve 82 to telescope over conduit 83 to thereby close the inlet. Furthermore, as soon as the pump chamber is raised upon actuation of the trigger, its valve seat 88 is moved away from wall 89 to thereby open the container vent formed between the tube 65 and central opening 64. Atmospheric air will then replenish the liquid dispensed from the container. A release of finger pressure on the trigger returns the pump parts to the FIG. 5 position whereupon container vent is closed, the outlet is closed and the inlet is opened to permit liquid to be suctioned from the container into the pump chamber through the gap formed between disengaged parts 82 and 83. Also, it can be seen that during reciprocation of the pump cylinder, the dip tube attached thereto moves within the container.

Obviously, many modifications and variations of the present invention are made possible in the light of the above teachings. For example, sleeves 57 and 82 may be made to telescope within their respective conduits 55 and 83 in a valve closing position, without departing from the invention. It is therefore to be understood that within the scope of the appended claims, the invention may be practiced otherwise than as specifically described.

What is claimed is:

1. A liquid dispensing pump, comprising a pump cylinder defining a pump chamber having a valved inlet opening, a reciprocable piston having an annular piston skirt at one end thereof in sliding engagement with the wall of said chamber between upstroke and downstroke positions of said piston, a discharge head for effecting downstroke movement of said piston, said discharge head having a discharge orifice, and a discharge passage extending through said piston and said head providing communication between said pump chamber and said orifice, said head being in sliding engagement with an opposite end of said piston for limited relative inward and outward shifting movement of said head for opening and closing said discharge passage, said piston having a valve member at said opposite end in engagement with the wall of said discharge passage in said head during the closing of said discharge passage, and said valve member comprising a valve skirt forming an annular opening with an enlarged section in said wall during the opening of said discharge passage, whereby inward depression of said discharge head effects an opening of said passage and moves said piston into said downstroke position, liquid thereby being dispensed from said chamber through said passage and orifice.

2. The pump according to claim 1, further comprising a pump body for mounting said cylinder on a liquid container, and means biasing said head into a position closing said discharge passage.

3. The pump according to claim 1, further comprising a pump body including a transverse flange having a central opening through which said piston extends, said piston skirt having a wall portion flaring outwardly in a direction toward said one end thereof, said wall portion bearing against the edge of said central opening at the end of the piston upstroke, and said pump cylinder having a container vent which is opened via said central opening upon the piston downstroke.

4. The pump according to claim 1, wherein said valved inlet opening comprises a ball check valve.

5. The pump according to claim 1, wherein said valved inlet opening comprises an upstanding conduit on said pump cylinder and a depending sleeve on said piston, said sleeve engaging said conduit during the piston downstroke for closing said inlet, and said sleeve disengaging said conduit near the end of the piston upstroke for opening said inlet.

6. The pump according to claim 1, further including means biasing said piston toward said upstroke position.

7. A liquid dispensing pump, comprising a pump body containing a pump cylinder and a pump piston having an annular depending piston skirt at one end thereof arranged for reciprocating sliding engagement with the wall of said cylinder during piston downstroke and upstroke movements, said cylinder defining a pump chamber and having a valve controlled inlet opening, a depressible discharge head having a discharge orifice, a discharge passage extending through said piston and said head providing communication between said chamber and said orifice, said head slideably engaging said piston for limited relative shifting movement of said head for opening and closing said passage, a discharge valve in said passage arranged to open and close respectively upon inward and outward movement of said head relative to said piston, said discharge valve comprising a valve member affixed to an opposite end of said piston for movement therewith and a valve seat in said head passage, whereby liquid is dispensed from said chamber during the piston downstroke upon the depression of said head.

8. The pump according to claim 7, wherein said piston and said discharge head are provided with stop elements arranged to permit said limited shifting movement, said stop elements interengaging when said discharge valve is closed.

9. The pump according to claim 7, wherein said valve controlled inlet comprises a ball check valve.

10. The pump according to claim 7, wherein said valve controlled inlet comprises an upstanding conduit on said pump cylinder and a depending sleeve on said piston, said sleeve engaging said conduit during the piston downstroke for closing said inlet, and said sleeve disengaging said conduit near the end of the piston upstroke for opening said inlet.

* * * * *